US008873981B2

(12) United States Patent
Fukumoto et al.

(10) Patent No.: US 8,873,981 B2
(45) Date of Patent: Oct. 28, 2014

(54) IMAGE FORMING APPARATUS WITH SEPARATION CONTROL OF DEVELOPING MEMBER AND CLEANING MEMBER DURING PRELIMINARY ROTATION

(75) Inventors: Kazuko Fukumoto, Ibaraki (JP); Atsuto Hirai, Ikoma (JP)

(73) Assignee: Konica Minolta Holdings, Inc., Tokyo (JP)

( * ) Notice: Subject to any disclaimer, the term of this patent is extended or adjusted under 35 U.S.C. 154(b) by 248 days.

(21) Appl. No.: 13/237,547

(22) Filed: Sep. 20, 2011

(65) Prior Publication Data

US 2012/0093530 A1 Apr. 19, 2012

(30) Foreign Application Priority Data

Oct. 15, 2010 (JP) ..... 2010-232425

(51) Int. Cl.
*G03G 15/10* (2006.01)

(52) U.S. Cl.
USPC ..... 399/57; 399/249

(58) Field of Classification Search
USPC ..... 399/53, 57, 237, 239, 249
See application file for complete search history.

(56) References Cited

U.S. PATENT DOCUMENTS

| | | | | |
|---|---|---|---|---|
| 5,387,760 | A * | 2/1995 | Miyazawa et al. | 399/239 |
| 7,676,181 | B2 * | 3/2010 | Ueda et al. | 399/239 |
| 8,200,125 | B2 * | 6/2012 | Tabata et al. | 399/237 |

FOREIGN PATENT DOCUMENTS

| | | | |
|---|---|---|---|
| JP | 02-248967 | | 10/1990 |
| JP | 2005315946 | A * | 11/2005 |
| JP | 2006106096 | A * | 4/2006 |
| JP | 2006343676 | A * | 12/2006 |
| JP | 2007148243 | A * | 6/2007 |
| JP | 2007304511 | A * | 11/2007 |
| JP | 2010217689 | A * | 9/2010 |

* cited by examiner

*Primary Examiner* — Robert Beatty
(74) *Attorney, Agent, or Firm* — Brinks Gilson & Lione

(57) ABSTRACT

An image forming apparatus includes: a development member carrying developer for forming a toner image on an image carrier; a cleaning member in contact with the development member for removing the developer left on the development member; a carrying member provided in contact with the development member, for carrying the supplied developer to the development member; a driving part driving at least one of the carrying member and the development member; and a regulating mechanism for separating the cleaning member and the development member from each other. The driving part causes preliminary rotation of the development member and the carrying member with the cleaning member separated from the development member, before starting main rotation for image formation.

3 Claims, 13 Drawing Sheets

IMAGE FORMING APPARATUS WITH SEPARATION CONTROL OF DEVELOPING MEMBER AND CLEANING MEMBER DURING PRELIMINARY ROTATION

This application is based on Japanese Patent Application No. 2010-232425 filed with the Japan Patent Office on Oct. 15, 2010, the entire content of which is hereby incorporated by reference.

BACKGROUND OF THE INVENTION

1. Field of the Invention

The present invention relates to an image forming apparatus based on electrophotography such as a copier, a printer or a facsimile and, more specifically, to an image forming apparatus provided with a development member such as a developing roller.

2. Description of the Related Art

In an image forming apparatus based on electrophotography, an electrostatic latent image on a photoreceptor as an image carrier is developed by a developing device with toner, and a toner image is formed. The toner image on the photoreceptor is transferred, for example, to a sheet of recording paper. In such a process of transfer in the image forming apparatus, generally, electrostatic transfer is utilized.

When a toner image is to be transferred to a sheet of paper as a receiver, a voltage is applied by a transfer roller or the like from the rear surface of the sheet arranged to face the photoreceptor, whereby an electric field is formed between the photoreceptor and the recording paper and by the electric field, the toner image is attracted in electrostatic manner to the recording paper.

Thereafter, the transferred toner image is pressed by a fixing device and fixed on the recording paper.

Dry and wet developing devices have been conventionally known as developing devices for the image forming apparatuses. In both types of devices, developer is fed to a developing roller, which is an elastic member, by means of a conveyer roller, and an electrostatic latent image on the photoreceptor is developed by the developing roller. In such a developing device, while an image is not formed, that is, in a period of non-image-formation, the developing roller, which is an elastic member, is in a stationary state.

When a surface of an elastic member (developing roller) is kept partially in pressure contact with another member (for example, a carrying roller), compressive strain generates at the portion of pressure contact on the surface of the elastic member. At the portion where the compressive strain generates, the force of pressure contact between the members decreases and, therefore, when the elastic member is rotated again for image formation, liquid developer cannot be passed uniformly, resulting in uneven density in a rotation period of the elastic member.

In the following, the mechanism how the generation of strain causes uneven density will be described, taking a wet developing device as an example.

When a member on the side of passing the liquid developer and a member on the side of receiving the developer are rotating in the same direction at a portion where these members are opposite to each other, generally, the liquid developer passes through the nip between the members and distributed to respective members at a ratio in accordance with the ratio of speed of the members.

If there is a strain on the surface of the elastic member, however, larger amount of liquid developer would be carried at the portion dented because of the strain.

Therefore, if there is a strain on the passing side member and large amount of developer is carried thereon, the amount fed to the receiving side member opposite thereto also increases.

Next, when a member on the side of passing the liquid developer and a member on the side of receiving the developer are rotating in the opposite directions at the portion where these members are opposite to each other, the liquid developer on the passing side member does not pass through the nip portion but fed to the receiving side member before reaching the nip. If there is a strain on the surface of passing side member, however, the force of pressure contact reduces at this portion and, therefore, the liquid developer tends to easily go through the nip. Where the developer slips through the nip, the amount of developer fed to the receiving side member decreases.

Because of the above-described mechanism, when there is a strain on the elastic member, the amount of liquid developer carried thereon increases or decreases, resulting in uneven density in the rotation period of the strained elastic member.

Such a problem of uneven density is also experienced in the dry developing device.

Japanese Laid-Open Patent Publication No. 02-248967 discloses, in a recording device in which development is done by a developing roller and a photoreceptor drum brought into contact with each other, a technique of rotating one or both of the developing roller and the photoreceptor drum for a prescribed time period at a prescribed time interval in a standby state, to remove the strain.

The method disclosed in Japanese Laid-Open Patent Publication No. 02-248967, simply rotate the developing roller or the like for a prescribed time period in the standby state to eliminate the strain. However if, for example, the developer is not adhered on the developing roller, such rotation may possibly result in abnormal friction with a cleaning blade provided on the developing roller. Such friction may cause irregular wear of the member such as the developing roller.

SUMMARY OF THE INVENTION

The present invention was made to solve the above-described problem, and its object is to provide an image forming apparatus capable of eliminating strain and preventing irregular wear of members.

One aspect of the present invention provides an image forming apparatus, including: a rotary development member for carrying developer to form a toner image on an image carrier; a cleaning member arranged in contact with the development member for removing the developer left on the development member at a time of main rotation for image formation; a rotary carrying member arranged in contact with the development member, for carrying and feeding the developer to the development member; a regulatory mechanism for separating the cleaning member and the development member from each other; a driving part for rotating at least one of the carrying member and the development member; and a controller for controlling the driving part and the regulatory member such that the development member performs a preliminary rotation with the cleaning member separated from the development member, before the main rotation.

The driving part of the image forming apparatus causes preliminary rotation of at least one of the developing member and the carrying member for a prescribed time period, with the cleaning member separated from the developing member, prior to the main rotation for image formation.

Consequently, wear of the developing member can be reduced since the cleaning member is separated, while eliminating strain of the rollers.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
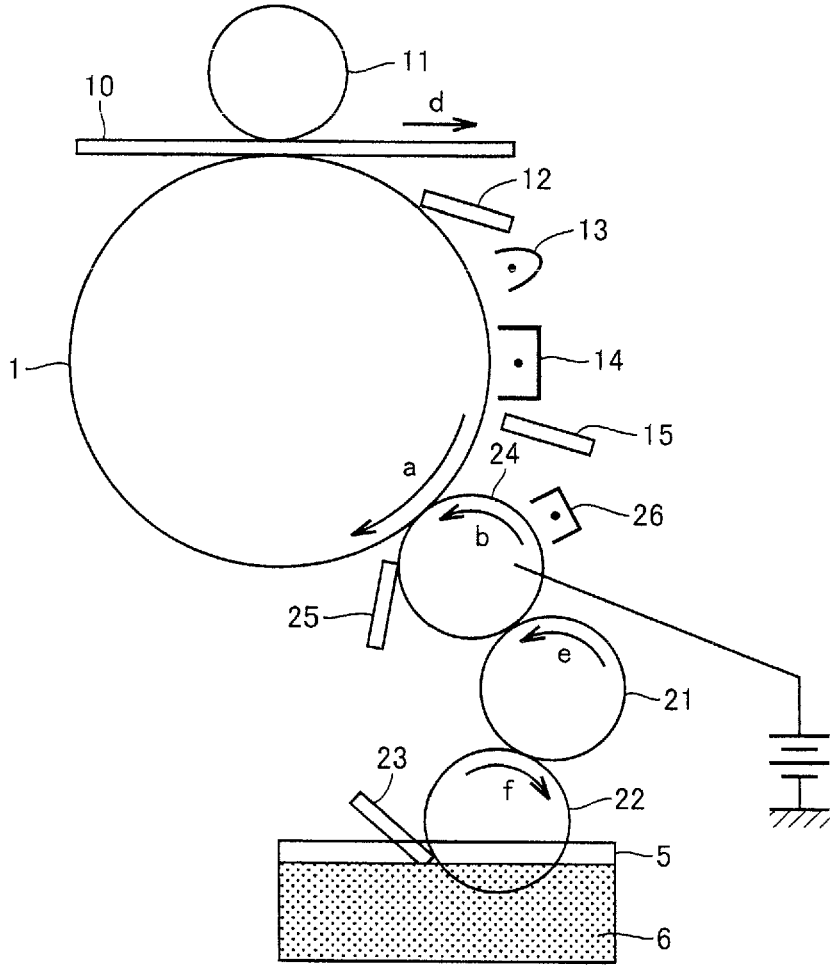
FIG. 1 schematically shows a configuration of an example of wet image forming apparatus in accordance with an embodiment of the present invention.

In the following, embodiments of the present invention will be described with reference to the figures. In the following description, the same parts and components are denoted by the same reference characters. Their names and functions are also the same.

In the embodiment of the present invention, a wet image forming apparatus will be described as a representative example of the image forming apparatus. The present invention is also applicable to a dry image forming apparatus.

Embodiment 1

FIG. 1 schematically shows a configuration of an example of wet image forming apparatus in accordance with an embodiment of the present invention.

Referring to FIG. 1, the wet image forming apparatus in accordance with Embodiment 1 of the present invention is provided with a photoreceptor 1, which is a drum-shaped image carrying body. Around photoreceptor 1, a charger 14, an exposure unit 15, a developing roller 24 of the developing device, a transfer roller 11, a cleaning blade 12 and an eraser lamp 13 are arranged in this order in the direction of rotation as represented by an arrow.

Photoreceptor 1 has its surface uniformly charged to a prescribed surface potential by charger 14. Thereafter, photoreceptor 1 is exposed according to the image information by exposure unit 15, and an electrostatic latent image is formed on the surface of photoreceptor 1. Then, the electrostatic latent image on photoreceptor 1 is developed with liquid developer including toner particles and carrier liquid by developing roller 24 of the developing device, whereby a toner image is formed on the surface of photoreceptor 1. Here, not only the toner particles but also the carrier liquid as the dispersing medium adheres to the surface of photoreceptor 1.

The toner image formed on the surface of photoreceptor 1 is carried to a transfer position opposite to transfer roller 11. At the transfer position, a receiving material 10 is moved in the direction of an arrow (direction "d"), and by the force of voltage of opposites polarity to the toner particles applied to transfer roller 11, the toner particles on photoreceptor 1 are transferred to receiving material 10. Receiving material 10 having the toner particles transferred thereto is carried to a fixing position, where the toner image is fixed.

After passing through the transfer position, there is cleaning blade 12 provided on photoreceptor 1, which collects residual toner particles and dispersion medium left on photoreceptor 1. After the toner particles and dispersing medium are recovered, photoreceptor 1 is exposed by eraser lamp 13, so that the latent image potential is cancelled. By repeating these process steps, images are successively printed.

Here, the liquid developer contains, as main components, insulating liquid as carrier liquid, toner particles for developing electrostatic latent images, and dispersing medium for dispersing the toner particles.

The types of carrier liquid are not specifically limited and any liquid generally used for liquid developer for electrophotography may be used. Non-volatile liquid is particularly preferable. Examples of non-volatile liquid may include silicone oil, mineral oil, and paraffin oil.

The types of toner particles are not specifically limited, and any toner particles generally used for liquid developer for electrophotography may be used. As toner binding resin, thermoplastic resin such as polystyrene resin, styrene acrylic resin, acrylic resin, polyester resin, epoxy resin, polyamide resin, polyimide resin or polyurethane resin may be used. Two or more of these may be mixed for use. Commercially available common pigments and dyes may be used for coloring toner. Examples of pigment may include carbon black, colcothar, titanium oxide, silica, phthalocyanine blue, phthalocyanine green, sky blue, benzidine yellow and lake red D. Examples of dye may include solvent red 27 and acid blue 9.

The developer may be prepared based on commonly used technique. By way of example, binder resin and pigment of prescribed blend ratio are melted and kneaded to be uniformly dispersed using a pressure kneader, roller mill or the like, and the resulting dispersed body is pulverized, for example, by a jet mill. The fine powder thus obtained is classified using, for example, an air classifier, whereby colored toner having desired particle size can be obtained. Thus obtained toner particles are mixed with an insulating liquid as the carrier liquid, with a prescribed blend ratio. The mixture is uniformly dispersed using dispersing means such as a ball mill, and thus, the liquid developer is obtained.

In the present example, 100 parts of polyester resin and 15 parts of copper phthalocyanine are fully mixed using a Henschel mixer, and melted and kneaded using a co-rotating twin screw extruder with heating temperature in roller being 100° C. The resulting mixture was cooled and roughly pulverized, and thus, rough pulverized toner was obtained. Then, 75 parts of IPS 2028 (manufactured by Idemitsu Kosan Co, Ltd.), 25 parts of the rough pulverized toner and 0.8 parts of V216 (manufactured by International Specialty Products Inc.) were mixed and subjected to wet pulverization for four days using a sand mill, and wet developer was obtained. The particle size at that time was 2.0 μm. The particle size was measured using a laser diffraction type particle size distribution measuring device (SALD-2200 (manufactured by Shimadzu Corporation)).

Next, the configuration of developing device will be briefly described. The details will be described later.

The developing device includes: a developing roller 24 to be in pressure contact with photoreceptor 1; a developer tank (storage container) 5 holding liquid developer 6 containing the toner and the carrier liquid; a draw-up roller 22 partially dipped in developer tank 5 for drawing up the liquid developer; a regulating member 23 regulating and measuring thickness of the liquid developer drawn up by draw-up roller 22; and a feed roller 21 for feeding the liquid developer drawn-up by draw-up roller 22 to developing roller 24.

Draw-up roller 22 and feed roller 21 positioned adjacent to each other rotate in directions such that the surfaces of them proceed in the same direction at a contact area. Further, draw-up roller 22 rotates as a driven roller, following feed roller 21. In the present example, draw-up roller 22 rotates in the direction "f". Further, feed roller 21 rotates in the direction "e".

Further, feed roller 21 and developing roller 24 positioned adjacent to each other rotate in the directions such that the surfaces of them proceed in opposite directions at the contact area. Accordingly, the liquid developer can efficiently be fed from feed roller 21 to developing roller 24. Further, a thin layer of developer on developing roller 24 can be made uniform. At the time of image formation, in the present example, feed roller 21 rotates in the direction "e" and developing roller 24 rotates in the direction "b".

As will be described later, in the present example, a driving mechanism (driving part) for rotation is provided for each of feed roller 21 and developing roller 24, and the driving mechanism is not provided for draw-up roller 22.

A metal roller having a large number of very fine dimples (Anilox roller) may be used as draw-up roller 22, to precisely regulate the amount of liquid developer.

Around developing roller 24, a charger 26 and a cleaning blade 25 are provided. As described above, a prescribed amount of liquid developer is fed to developing roller 24, and by charger 26, toner contained in the liquid developer is electrically charged. Thereafter, the charged toner conveyed to photoreceptor 1 by developing roller 24 develops the image portion on photoreceptor 1. Here, photoreceptor 1 rotates in the direction "a".

The respective rollers have a cylindrical shape, and are shown in cross sections here.

Cleaning blade 25 may be formed of rubber or a rigid body. Examples of the rubber may include but are not limited to urethane rubber, NBR rubber and fluoro-rubber. Examples of the rigid body may include but are not limited to resin such as polypropylene, ABS or polycarbonate, and metal such as aluminum, alumite, SUS or brass.

FIG. 1 represents the configuration of a wet image forming apparatus capable of forming an image in a single color (for example, black). In the following, a wet image forming apparatus capable of forming an image in a plurality of colors (full color) will be described.

Figure 2:
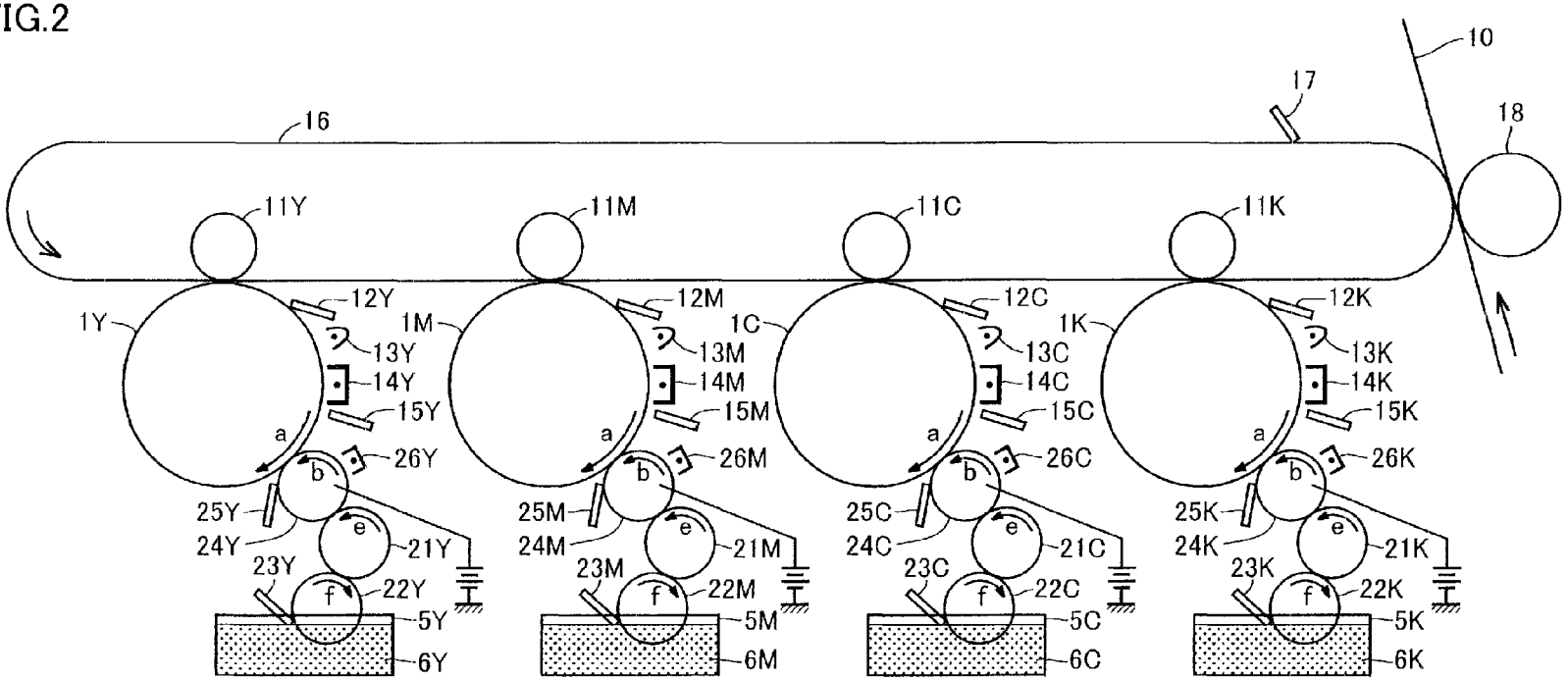
FIG. 2 schematically shows a configuration of another example of wet image forming apparatus in accordance with an embodiment of the present invention.

FIG. 2 schematically shows a configuration of another example of wet image forming apparatus in accordance with an embodiment of the present invention.

Referring to FIG. 2, a wet image forming apparatus in accordance with an embodiment of the present invention is provided with an intermediate transfer belt 16 as an image carrier, and around intermediate transfer belt 16, a photoreceptor 1Y for yellow, a photoreceptor 1M for magenta, a photoreceptor 1C for cyan and a photoreceptor 1K for black are arranged in this order along the direction of rotation represented by the arrow. Further, transfer rollers 11Y, 11M, 11C and 11K are provided opposite to photoreceptors 1, with intermediate transfer belt 16 positioned therebetween.

On the further downstream side of intermediate transfer belt 16 in the direction of rotation, a transfer roller 18 and a cleaning blade 17 are arranged.

Around photoreceptor 1 for each color, charger 14, exposure unit 15, developing roller 24 of the developing device, transfer roller 11, cleaning blade 12 and eraser lamp 13 are arranged.

As described above, the developing device includes: a developing roller 24 to be in pressure contact with photoreceptor 1; a developer tank 5 holding liquid developer 6 containing toner and carrier liquid; a draw-up roller 22 partially dipped in developer tank 5 for drawing up the liquid developer; a regulating member 23 adjusting and measuring thickness of the liquid developer drawn up by draw-up roller 22; and a feed roller 21 for feeding the liquid developer drawn-up by draw-up roller 22 to developing roller 24.

Here, the characters Y, M, C and K appended to the reference numerals represent that the components are for yellow, magenta, cyan and black, respectively.

The toner image developed on each photoreceptor 1 is transferred to intermediate transfer belt 16 by means of transfer roller 11. The toner images transferred to intermediate transfer belt 16 are superposed color by color and carried to the transfer position that is opposite to transfer roller 18. At the transfer position, receiving material 10 is moved in the direction of the arrow, and the toner image on intermediate transfer belt 16 is transferred by transfer roller 11 to receiving material 10. Thereafter, the toner image is fed to the fixing position, not shown, where the toner image is fixed.

In the following, preliminary rotation of the developing device before the main rotation for image formation will be described. For simplicity of description, the configuration of the embodiment shown in FIG. 1 will be referred to. The configuration is not limited to the type of FIG. 1, and the present invention is similarly applicable to the configuration of FIG. 2.

Figure 3:
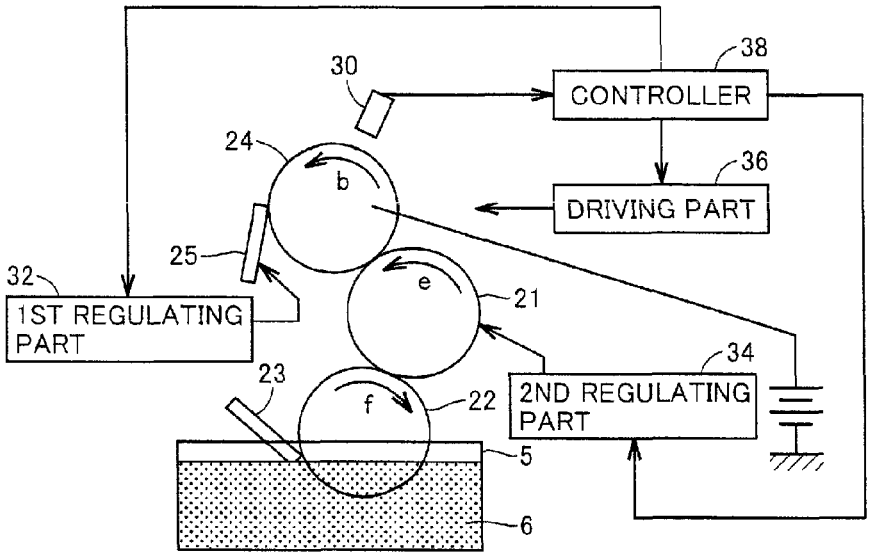
FIG. 3 shows a configuration of a developing device in accordance with Embodiment 1 of the present invention.

FIG. 3 shows a configuration of a developing device in accordance with Embodiment 1 of the present invention.

Referring to FIG. 3, the developing device includes: developing roller 24 to be in pressure contact with photoreceptor 1; developer tank 5 holding liquid developer 6 containing toner and carrier liquid; draw-up roller 22 partially dipped in developer tank 5 for drawing up the liquid developer; regulating member 23 measuring and regulating thickness of the liquid developer drawn up by draw-up roller 22; feed roller 21 for feeding the liquid developer drawn-up by draw-up roller 22 to developing roller 24; cleaning blade 25 for removing the liquid developer left on the developing roller after the image portion is developed on photoreceptor 1; a first regulating part 32 for regulating contact between developing roller 24 and cleaning blade 25; a second regulating part 34 regulating the position of feed roller 21; a driving part 36 for rotating developing roller 24 and feed roller 21; and a detecting sensor 30 provided for developing roller 24, for detecting presence/absence of liquid developer adhered on developing roller 24. Further, a controller 38 for controlling the developing device is provided, adjusting the position of the feed roller or giving instruction to driving part 36. Detecting sensor 30 is, for example, an optical sensor, which periodically detects light reflected from the surface of developing roller 24. Further, detecting sensor 30 outputs a signal to controller 38 in accordance with presence/absence of the developer.

Figure 4A:
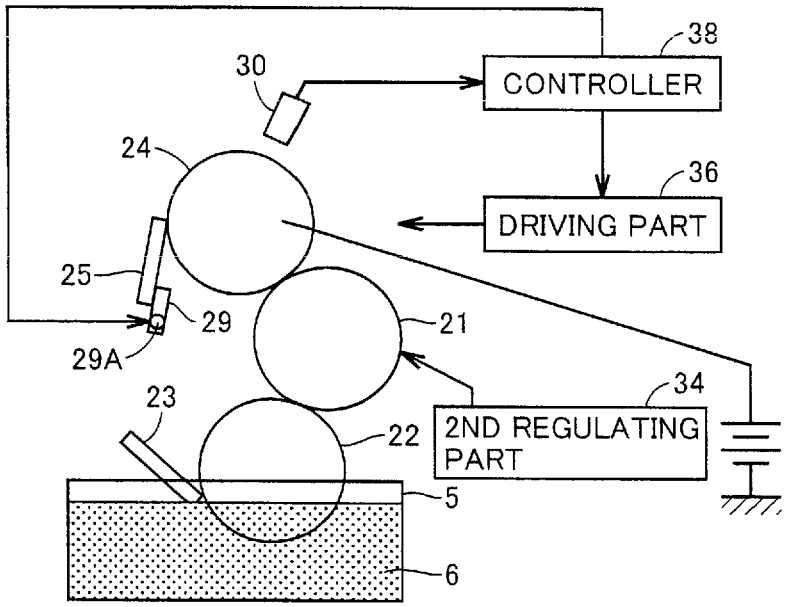
FIGS. 4A and 4B show an operation of a first regulating part 32 in accordance with Embodiment 1 of the present invention.
Figure 4B:
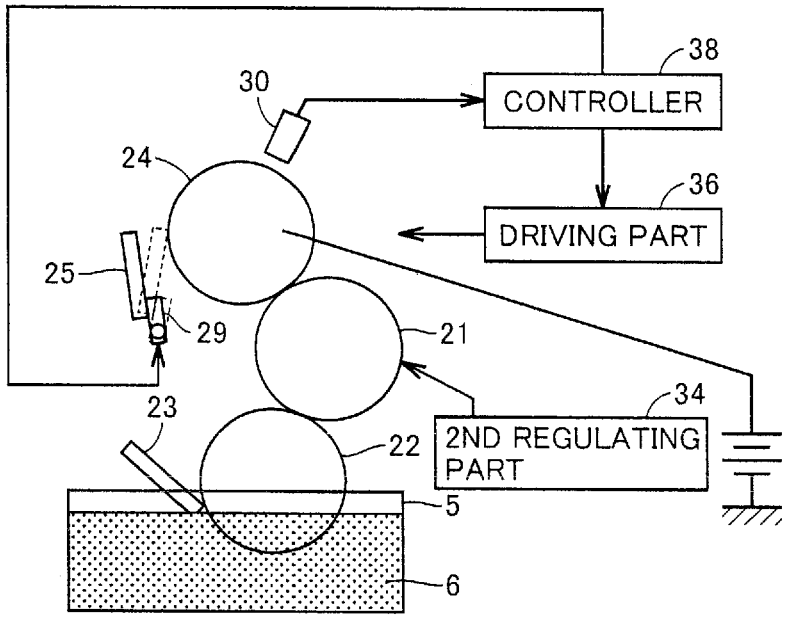

FIGS. 4A and 4B show an operation of the first regulating part 32 in accordance with Embodiment 1 of the present invention.

Referring to FIGS. 4A and 4B, in the present example, a rotating mechanism 29 pivotally supported and abutting cleaning blade 25 is provided as the first regulating part 32. By way of example, rotating mechanism 29 has a shape of a plate of the same width as cleaning blade 25, extending in the longitudinal direction of developing roller 24, fixed at the abutting position on cleaning blade 25, and is pivotally supported by a rotation shaft 29*a* integral with cleaning blade 25. Rotating mechanism 29 has one end connected to a motor, not shown, and rotates in accordance with an instruction from controller 38. As rotating mechanism 29 rotates, integrally and pivotally supported cleaning blade 25 also rotates and moves between the positions where it is in contact with and separated from the developing roller. FIG. 4A shows a state in which cleaning blade 25 is in contact with developing roller 24.

FIG. 4B shows a state in which, from the state shown in FIG. 4A, cleaning blade 25 and developing roller 24 are separated from each other, as a result of rotation of rotating mechanism 29 in accordance with an instruction from controller 38.

Figure 5A:
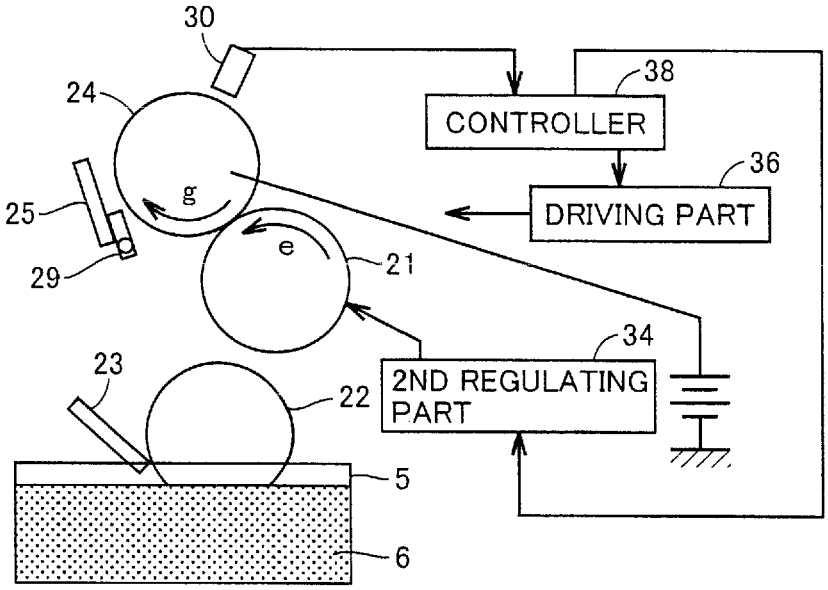
FIGS. 5A and 5B show an operation of a second regulating part 34 in accordance with Embodiment 1 of the present invention.
Figure 5B:
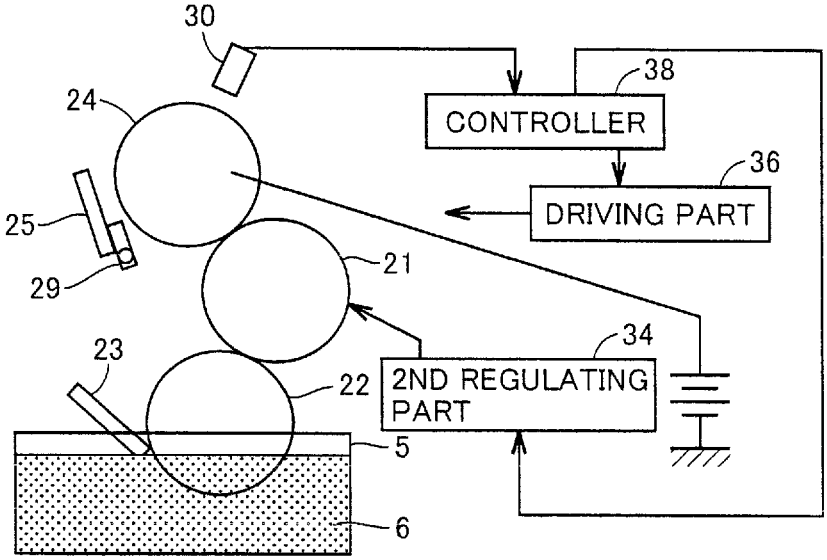

FIGS. 5A and 5B show an operation of the second regulating part 34 in accordance with Embodiment 1 of the present invention.

FIG. 5A shows a state in which the second regulating part 34 regulates the position of feed roller 21 so that it is separated from draw-up roller 22.

In this state, driving part 36 rotates feed roller 21 in the rotating direction "e". In the present example, developing roller 24 rotates as a driven roller, following feed roller 21, in the direction "g".

By rotating developing roller 24 and feed roller 21, the strain generated at the contact area can be eliminated.

Further, since feed roller 21 and draw-up roller 22 are separated, the liquid developer drawn-up by draw-up roller 22 does not adhere to feed roller 21. Therefore, liquid developer is not unnecessarily drawn up from developer tank 5 and the liquid is not wasted.

Further, since developing roller 24 and feed roller 21 are rotated in the directions such that the surfaces of them proceed in the same direction at the contact area, it is possible to prevent excessive friction between the rollers even when developing roller 24 and feed roller 21 are rotated without any developer adhered thereon.

Referring to FIG. 5B, here, draw-up roller 22 and feed roller 21 are again in contact with each other, as the second regulating part 34 so regulated the position of feed roller 21.

Figure 6:
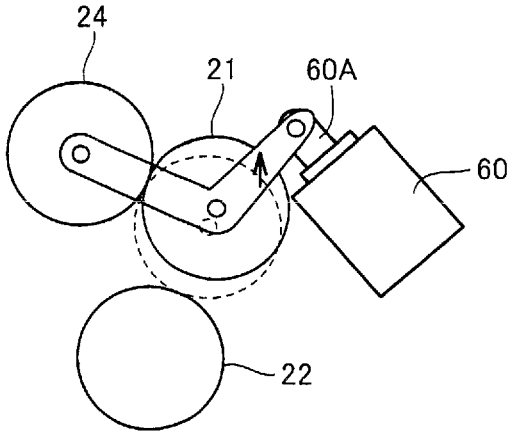
FIG. 6 shows an operation of a second regulating part 34 in accordance with Embodiment 1 of the present invention.

As an example, a mechanism including a solenoid as a pressing mechanism may be used for the second regulating part 34. Specifically, as shown in FIG. 6, a solenoid 60 as the pressing mechanism presses out a plunger 60A in accordance with an instruction from controller 38, so that a lever coupling the rotating shafts of developing roller 24 and feed roller 21 is rotated about the rotation axis of developing roller 24, whereby feed roller 21 moves along the circumference of developing roller 24.

Figure 7:
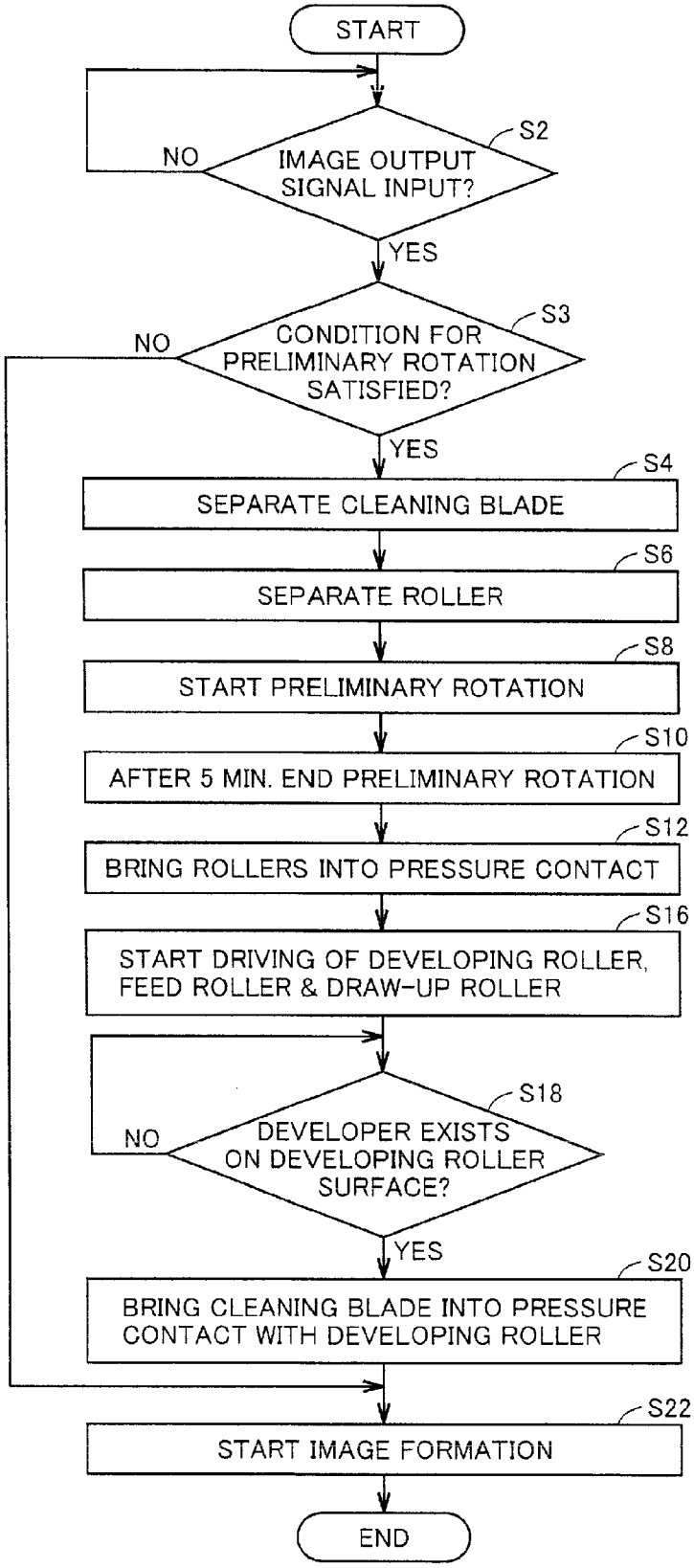
FIG. 7 is a flowchart representing a process executed by a controller 38 before the main rotation for image formation in accordance with Embodiment 1 of the present invention.

FIG. 7 is a flowchart representing a process executed by controller 38 before the main rotation for image formation in accordance with Embodiment 1 of the present invention.

First, determination is made as to whether or not an image output signal for forming an image has been input (step S2).

If it is determined at step S2 that the image output signal has been input, the control proceeds to step S3.

If it is determined at step S2 that the image output signal has not been input (NO at step S2), the state is maintained.

Next, controller 38 determines whether or not a condition for preliminary rotation is satisfied (step S3). By way of example, the condition for preliminary rotation is that a prescribed time period has passed from the last input of image output signal. The condition is not limited to the above, and other condition may be used to determine that the preliminary rotation is necessary. Though determination as to whether or not the condition for preliminary rotation is satisfied is made at step S3 in the present example, step S3 may be omitted, and the control may directly proceed from step S2 to step S4. In other words, the preliminary rotation may be executed every time an image output signal is input.

If it is determined at step S3 that the condition for preliminary rotation is satisfied (YES at step S3), cleaning blade 25 is separated (step S4).

Specifically, controller 38 instructs rotating mechanism 29 as the first regulating part 32 to separate cleaning blade 25 from developing roller 24 as shown in FIG. 4B.

Thereafter, feed roller 21 is separated (step S6). Specifically, controller 38 instructs solenoid 60 of pressing mechanism as the second regulating part 34 to separate feed roller 21 from draw-up roller 22.

Thereafter, the preliminary rotation starts (step S8). Specifically, controller 38 instructs driving part 36 to rotate feed roller 21. In the present example, in the preliminary rotation, developing roller 24 rotates as a driven roller, following feed roller 21. Each of the rollers may be provided as a driving roller, and the rollers may be rotated in the directions such that the surfaces of them proceed in opposite directions at the contact area.

After five minutes, the preliminary rotation ends (step S10). Specifically, controller 38 instructs driving part 36 to stop rotation of feed roller 21.

Thereafter, feed roller 21 is brought into pressure contact (step S12). Specifically, controller 38 instructs solenoid 60 of the pressing mechanism as the second regulating part 34, to regulate the position of feed roller 21. In the present example, the position of feed roller 21 is regulated such that it is again brought into contact with draw-up roller 22.

Next, rotation of developing roller 24, feed roller 21 and draw-up roller 22 starts (step S16). Specifically, controller 38 instructs driving part 36 to rotate feed roller 21 and developing roller 24. As described above, by the rotation of the rollers, liquid developer 6 in developer tank 5 is drawn up.

Next, determination is made as to whether the liquid developer drawn-up by the rotation started at step S16 has reached the surface of developing roller 24 (step S18). Specifically, controller 38 determines whether or not an input of detection result (liquid developer present) from detecting sensor 30 has been received.

If it is determined that the liquid developer is present on the surface of developing roller 24 (YES at step S18), cleaning blade 25 is brought into pressure contact with developing roller 24 (step S20). Specifically, controller 38 instructs rotating mechanism 29 as the first regulating part 32 to bring cleaning blade 25 into contact with developing roller 24.

Then, controller 38 starts image formation (step S22). Then, the process ends (END).

The condition for preliminary rotation means the time elapsed from the last rotation is short. In such a situation, there would not be any strain on developing roller 24. Therefore, preliminary rotation is determined to be unnecessary.

In this case, though determination as to whether preliminary rotation is to be done is made when the image output signal is input, the determination may be made when the power is turned ON. In that case, the determination at step S3 may be modified such that preliminary rotation is done based on the elapsed time period from the last power ON or power OFF, for example, the preliminary rotation may be executed if one day or longer has passed from the last power ON, or 12 hours or more have passed from the last power OFF. Alternatively, the elapsed time from the last image output signal may be checked, and preliminary rotation may be executed if 12 hours or longer have passed. If the preliminary rotation is done after power ON, the flow ends after the step of S20, and the control enters the standby state, waiting for an output of image output signal.

In the developing device in accordance with Embodiment 1, it is possible to eliminate the strain on developing roller or the like as described above, by the preliminary rotation before image formation. At this time, cleaning blade 25 is separated from developing roller 24 and, therefore, friction with cleaning blade 25 as developing roller 24 rotates can be avoided, and wear of developing roller 24 is reduced. Photoreceptor 1 is formed of a rigid body and has high wear resistance. Therefore, it is considered to be less prone to wear. Developing roller 24, however, is not formed of a rigid body and rubber or the like is used as the material. Therefore, it is desirable to separate cleaning blade 25 to prevent friction. Further, not only the wear of developing device 24 but also wear of cleaning blade 25 can also be prevented and the life thereof can be made longer.

In the main rotation for image formation, developing roller 24 and feed roller 21 rotate in the directions such that the surfaces of them proceed in opposite directions at the contact area. If such a rotation is done as the preliminary rotation without supplying the liquid developer, torque between the rollers increases, possibly makes the rotation unstable. The increase of the torque can be prevented by rotating developing roller 24 and feed roller 21 in the directions such that the surfaces of them proceed in the same direction at the contact area. Here, it is more desirable that developing roller 24 and feed roller 21 are rotated without any difference in speed at the contact area.

Further, in the preliminary rotation, feed roller 21 and draw-up roller 22 are rotated separately from each other, and the liquid developer is not fed to developing roller 24 or photoreceptor 1 from draw-up roller 22 through feed roller 21. Therefore, the liquid developer in developer tank 5 is not wasted.

Further, the timing when cleaning blade 25 is again brought into contact with developing roller 24 is after the detection of liquid developer adhered on developing roller 24. Since the liquid developer exists between cleaning blade 25 and developing roller 24, excessive friction can be prevented.

Modification 1

Figure 8A:
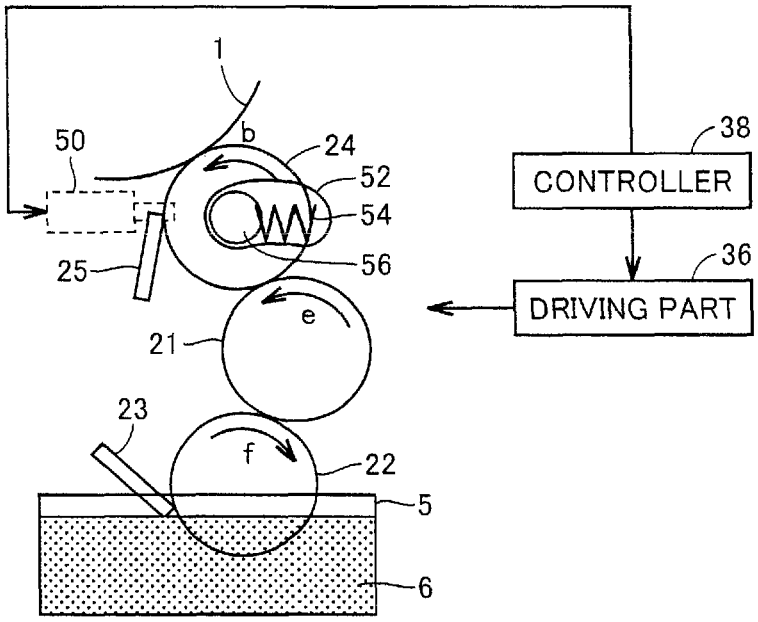
FIGS. 8A and 8B show a configuration of a developing device in accordance with Modification 1 of Embodiment 1 of the present invention.
Figure 8B:
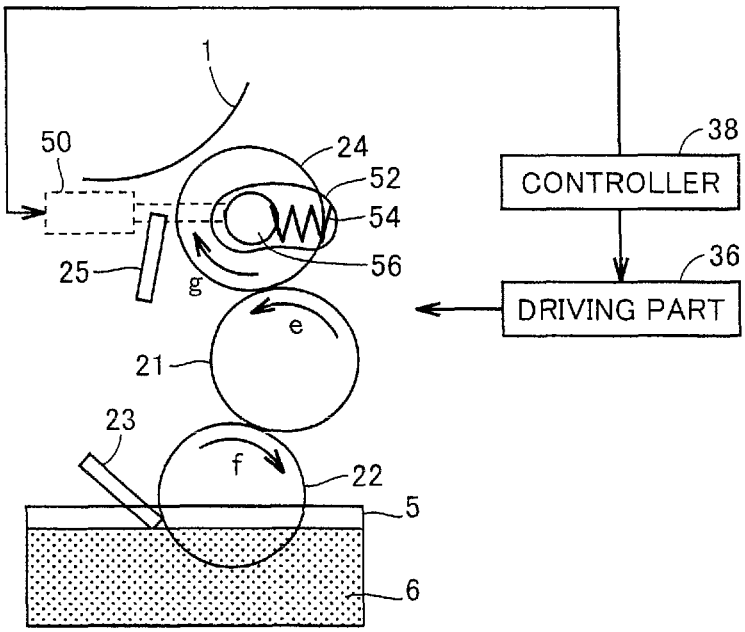

FIGS. 8A and 8B show a configuration of a developing device in accordance with Modification 1 of Embodiment 1 of the present invention.

Referring to FIG. 8A, the state of main rotation at the time of image formation in accordance with the present example will be described. Here, as the first regulating part 32, a pressing mechanism 50, a spring 54 coupled to a rotation shaft 56 of developing roller 24, and a sliding slot 52 formed on a part of a housing, not shown, in which rotation shaft 56 is slidable are provided. Spring 54 has one end coupled to rotation shaft 56 and the other end fixed. Further, rotation shaft 56 of developing roller 24 is urged by spring 54 to the direction to be in contact with cleaning blade 25. Further, developing roller 24 is slidable along sliding slot 52.

FIG. 8B shows the positions of respective rollers at the time of preliminary rotation in the present example. Here, prior to the preliminary rotation, pressing mechanism 50 presses rotation shaft 56 of developing roller 24 in accordance with an instruction from controller 38, whereby developing roller 24 moves against the urging force of spring 54 along the sliding slot 52. By this movement, developing roller 24 is separated from cleaning blade 25. By way of example, a solenoid and a plunger may be used as pressing mechanism 50.

Further, in the present example, transition from the state that photoreceptor 1 and developing roller 24 are in contact with each other to the state that they are separated from each other is attained by the positional change of developing roller 24.

Figure 9:
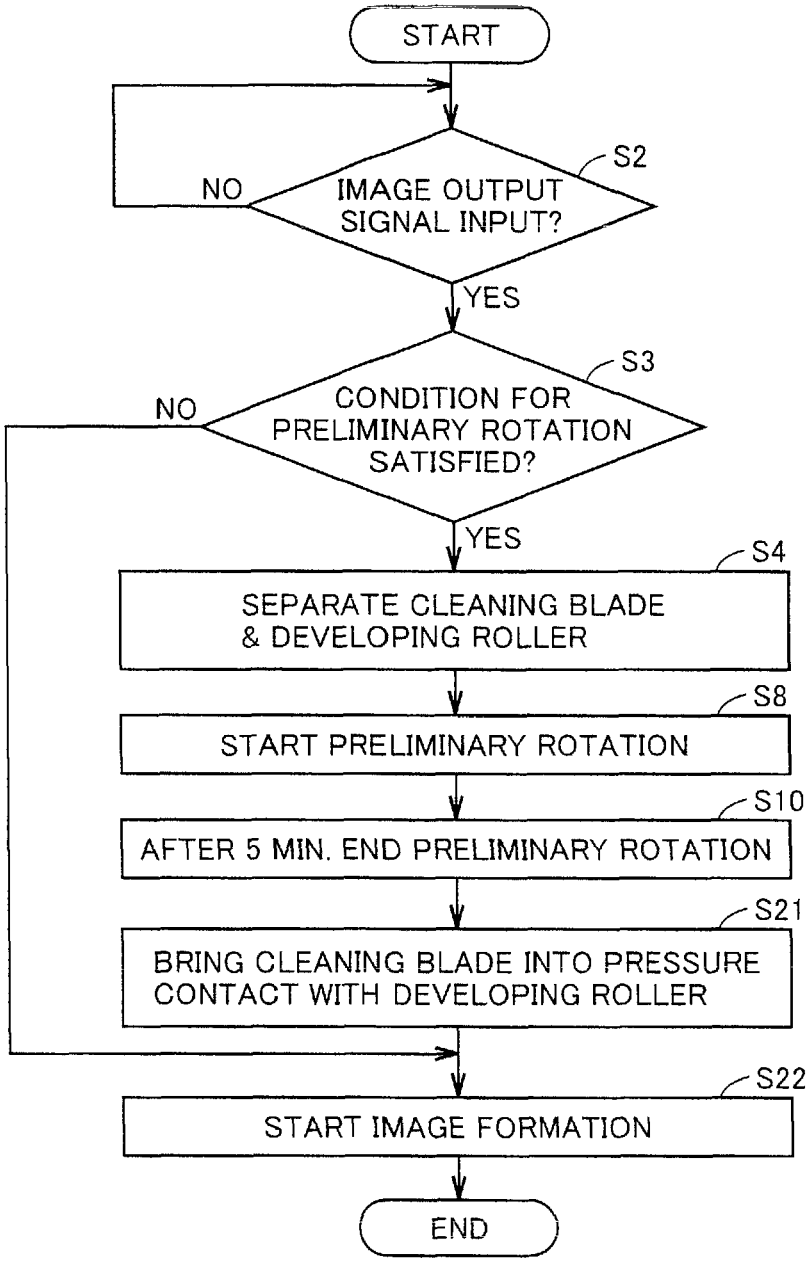
FIG. 9 is a flowchart representing a process executed by controller 38 before the main rotation for image formation in accordance with Modification 1 of Embodiment 1 of the present invention.

FIG. 9 is a flowchart representing a process executed by controller 38 before the main rotation for image formation in accordance with Modification 1 of Embodiment 1 of the present invention.

Referring to FIG. 9, first, determination is made as to whether the image output signal has been input (step S2). If it is determined at step S2 that the image output signal has been input, the control proceeds to step S3. If it is determined at step S2 that the image output signal has not been input (NO at step S2), the state is maintained.

Next, controller 38 determines whether or not a condition for preliminary rotation is satisfied (step S3).

If it is determined at step S3 that the condition for preliminary rotation is satisfied (YES at step S3), controller 38 instructs pressing mechanism 50 to press rotation shaft 56 of developing roller 24, so that developing roller 24 moves along sliding slot 52. By this movement, developing roller 24 is separated from both cleaning blade 25 and photoreceptor 1 (step S4).

Next, preliminary rotation starts (step S8). Specifically, controller 38 instructs driving part 36 to rotate feed roller 21. In the present example, it is assumed that in the preliminary rotation, developing roller 24 rotates as a driven roller, following feed roller 21.

After five minutes, the preliminary rotation ends (step S10). Specifically, controller 38 instructs driving part 36 to stop rotation of feed roller 21.

Next, controller 38 instructs pressing mechanism 50 to release rotation shaft 56 of developing roller 24. As described above, rotation shaft 56 of developing roller 24 is urged to the direction to be in contact with cleaning blade 25 by spring 54, and because of the urging force, developing roller 24 is again brought into contact with cleaning blade 25. Similarly, developing roller is brought into contact (pressure contact) with photoreceptor 1 (step S21).

Then, controller 38 starts image formation (step S22). Then, the process ends (END).

Also in the configuration in accordance with Modification 1 of Embodiment 1, it is possible to eliminate strain on the developing roller or the like by the preliminary rotation of rollers before image formation, as described above. At that time, as cleaning blade 25 is separated from developing roller 24, friction with cleaning blade 25 while developing roller 24 rotates can be avoided, and wear of developing roller 24 can be reduced. Since the developer is carried to the developing roller even during the preliminary rotation, abnormal friction does not occur even when the cleaning blade is brought into pressure contact immediately after the preliminary rotation. Since photoreceptor 1 is separated from developing roller 24, the developer is not supplied to photoreceptor 1 during the preliminary rotation and, hence, unnecessary consumption of liquid developer can be prevented.

Further, in the configuration of the developing device in accordance with Modification 1, by pressing mechanism 50, separation between cleaning blade 25 and developing roller 24 and separation between photoreceptor 1 and developing roller 24 are realized at the same time. Therefore, it is unnecessary to provide the second regulating part 34, and simpler configuration is realized.

Modification 2

Figure 10:
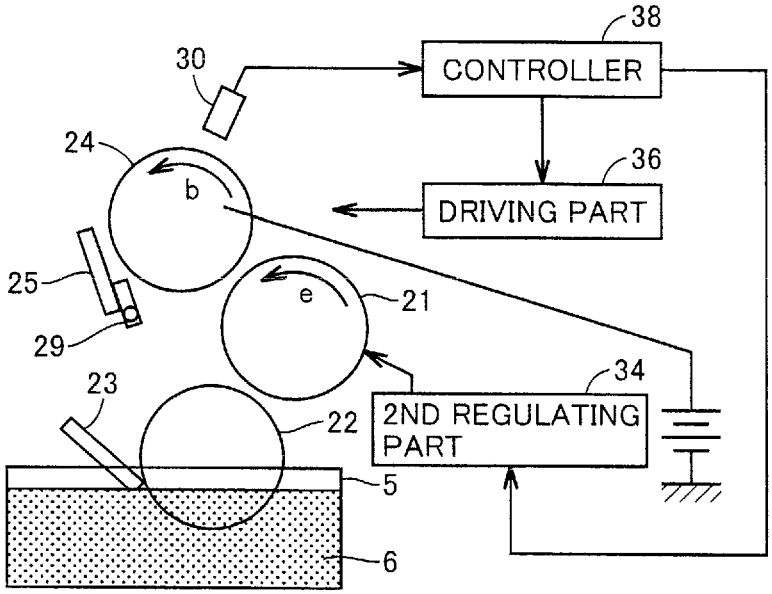
FIG. 10 shows a configuration of a developing device in accordance with Modification 2 of Embodiment 1 of the present invention.

FIG. 10 shows a configuration of a developing device in accordance with Modification 2 of Embodiment 1 of the present invention.

FIG. 10 shows the state at the time of preliminary rotation in accordance with Modification 2 of Embodiment 1 of the present invention. As compared with the configuration shown in FIG. 5, in the present example, the second regulating part 34 regulates the position of feed roller 21 so that draw-up roller 22 and feed roller 21 are separated, and further, feed roller 21 and developing roller 24 are separated as well. In this case, these rollers are kept partially in pressure contact with each other at the time of main rotation and at standby statuses, and the rollers are separated only at the time of preliminary rotation.

Figure 11:
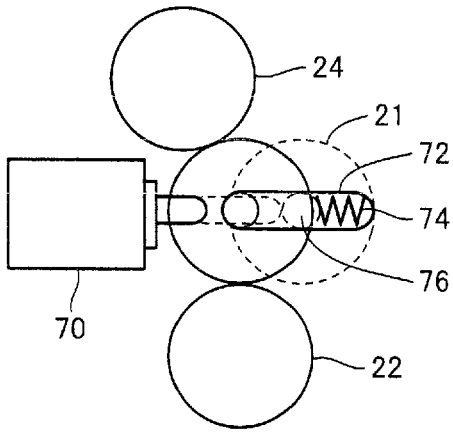
FIG. 11 shows an operation of a second regulating part 34 in accordance with Modification 2 of Embodiment 1 of the present invention.

Specifically, as shown in FIG. 11, as the first regulating part 32, a pressing mechanism 70, a spring 74 coupled to the rotation shaft 76 of feed roller 21, and a sliding slot 72 formed on a part of a housing, not shown, in which rotation shaft 76 is slidable, are provided. Spring 74 has one end coupled to rotation shaft 76 and the other end fixed. Further, rotation shaft 76 of feed roller 21 is urged by spring 74 in a direction to be in contact with developing roller 24 and draw-up roller 22. Further, feed roller 21 is slidable along sliding slot 72.

In accordance with an instruction from controller 38, pressing mechanism 70 presses rotation shaft 76 of feed roller 21, whereby feed roller 21 moves in a direction against the urging force of spring 74 along sliding slot 72. By this movement, feed roller 21 comes to be separated from developing roller 24 and draw-up roller 22. By way of example, a solenoid and a plunger may be used as pressing mechanism 70.

Further, as shown in FIG. 10, driving part 36 rotates feed roller 21 in the direction "e". Further, in the present example, driving part 36 also rotates developing roller 24 in the direction "b".

Since developing roller 24 and feed roller 21 are rotated separated from each other, the strain on developing roller 24 and feed roller 21 generated at the contact area can be eliminated.

Further, since feed roller 21 and draw-up roller 22 are separated, the liquid developer drawn-up by draw-up roller 22 does not adhere to feed roller 21. Therefore, unnecessary drawing of liquid developer from developer tank 5 can be prevented, and the liquid developer is not wasted.

Other parts and portions are the same as those described with reference to FIGS. 4 and 5. Specifically, the process before the main rotation for the image formation by controller 38 described with reference to FIG. 7 is similarly applicable.

The first regulating part for separating cleaning blade 25 from the developing roller is the same as that described with reference to FIG. 4. Since cleaning blade 25 is separated at the time of preliminary rotation, friction with cleaning blade 25 as developing roller 24 rotates can be avoided, and wear of developing roller 24 can be reduced.

Embodiment 2

In Embodiment 1, the configurations have been described in which the positions of rollers such as the feed roller are changed. In Embodiment 2 of the present invention, an approach will be described in which the position of rollers are not changed.

Figure 12:
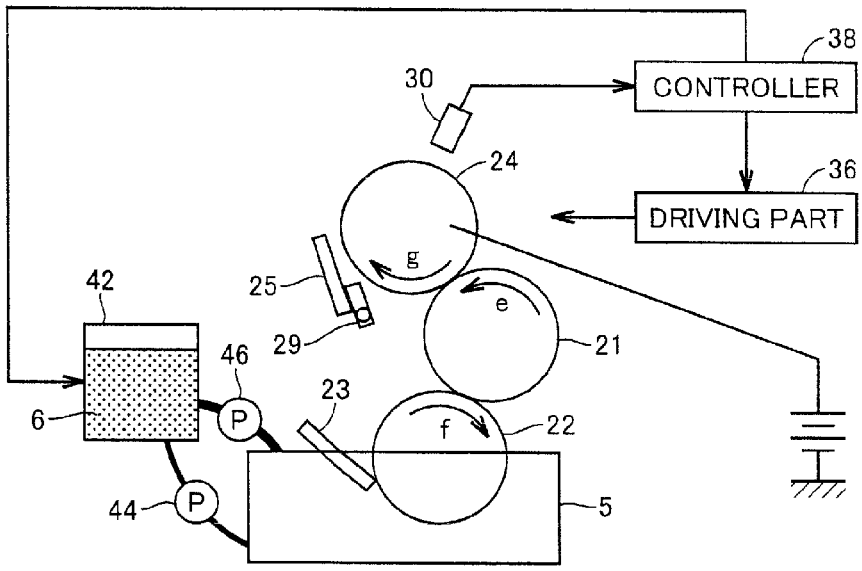
FIG. 12 shows a configuration of a developing device in accordance with Embodiment 2 of the present invention.

FIG. 12 shows a configuration of a developing device in accordance with Embodiment 2 of the present invention.

Referring to FIG. 12, the developing device in accordance with Embodiment 2 of the present invention is different from the configuration shown in FIG. 4 in that it additionally includes a regulating tank 42 and pumps 44 and 46. Here, pump 46 feeds liquid developer held in regulating tank 42 into developer tank 5 in accordance with an instruction from controller 38. Pump 44 takes out the liquid developer held in developer tank 5 to regulating tank 42 in accordance with an instruction from controller 38.

The first regulating part which separates cleaning blade 25 from the developing roller is the same as that described with reference to FIG. 4. Since cleaning blade 25 is separated at the time of preliminary rotation, friction with cleaning blade 25 as developing roller 24 rotates can be avoided, and wear of developing roller 24 can be reduced.

Figure 13:
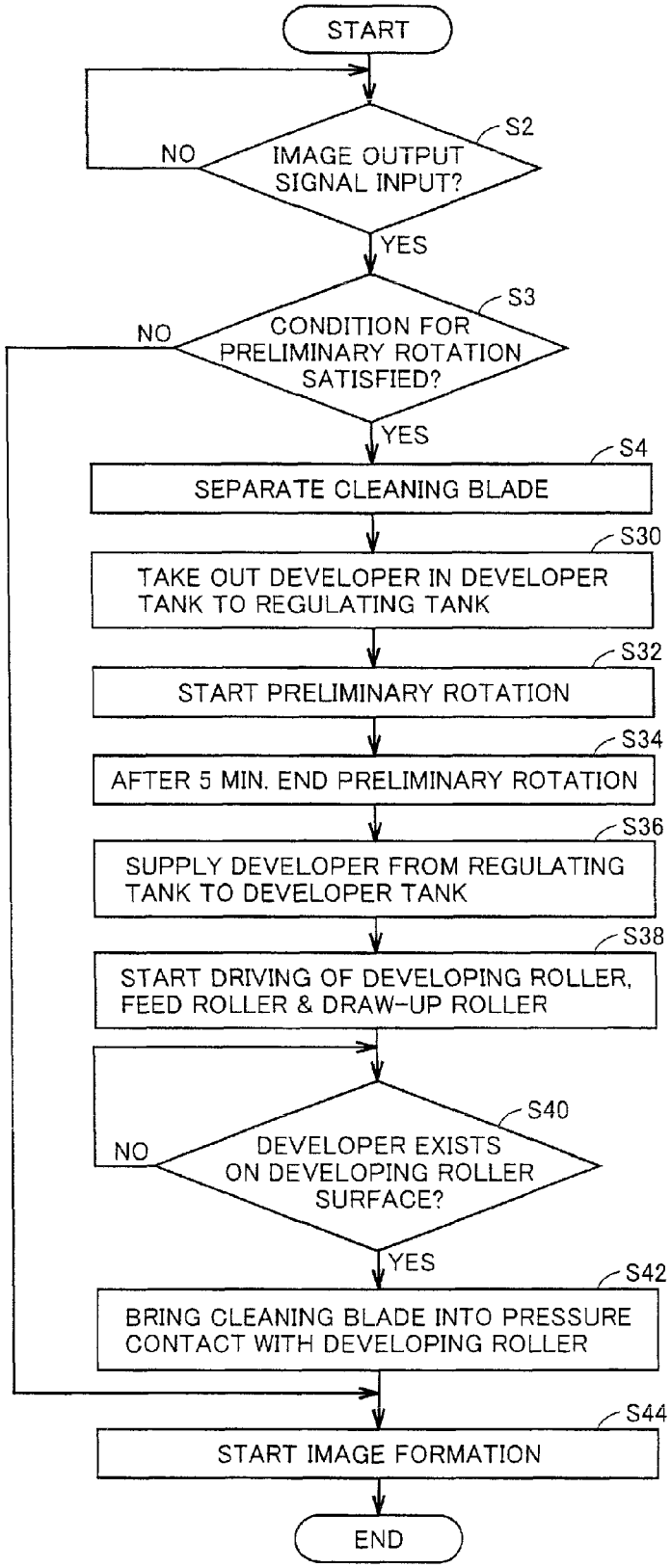
FIG. 13 is a flowchart representing a process executed by a controller 38 before the main rotation for image formation in accordance with Embodiment 2 of the present invention.

FIG. 13 shows a process executed by controller 38 before the main rotation for image formation in accordance with Embodiment 2 of the present invention.

Referring to FIG. 13, first, determination is made as to whether or not an image output signal for forming an image has been input (step S2). If it is determined at step S2 that the image output signal has been input, the control proceeds to step S3.

If it is determined at step S2 that the image output signal has not been input (NO at step S2), the state is maintained.

Next, controller 38 determines whether or not a condition for preliminary rotation is satisfied (step S3). If it is determined at step S3 that the condition for preliminary rotation is satisfied (YES at step S3), cleaning blade 25 is separated (step S4).

As described above, controller 38 instructs rotating mechanism 29 as the first regulating part 32 to separate cleaning blade 25 from developing roller 24.

Thereafter, the liquid developer in developer tank 5 is taken out to regulating tank 42 (step S30). Specifically, controller 38 instructs pump 44 to pump the liquid developer up from developer tank 5 and feed it into regulating tank 42.

Thereafter, the preliminary rotation starts (step S32). Specifically, controller 38 instructs driving part 36 to rotate feed roller 21. In the preliminary rotation, developing roller 24 rotates as a driven roller, following feed roller 21. Here, an example is shown in which developing roller 24 rotates in the direction "g". Because of such following rotation, increase of torque between the rollers can be prevented, even if the developer is not supplied during rotation.

After five minutes, the preliminary rotation ends (step S34). Specifically, controller 38 instructs driving part 36 to stop rotation of feed roller 21.

Next, the liquid developer is supplied from regulating tank 42 to developer tank 5 (step S36). Specifically, controller 38 instructs pump 46 to feed the liquid developer in regulating tank 42 into developer tank 5.

Thereafter, rotation of developing roller 24, feed roller 21 and draw-up roller 22 starts (step S38). Specifically, controller 38 instructs driving part 36 to rotate feed roller 21 and developing roller 24. In the present example, it is assumed that draw-up roller rotates as a driven roller following feed roller 21, and by the rotation of the draw-up roller, liquid developer 6 of developer tank 5 is drawn up.

Next, determination is made as to whether the liquid developer drawn-up by the rotation started at step S38 has reached the surface of developing roller 24 (step S40). Specifically, controller 38 determines whether or not an input of detection result (liquid developer is present) from detecting sensor 30 has been received.

If it is determined that the liquid developer is present on the surface of developing roller 24 (YES at step S40), cleaning blade 25 is brought into pressure contact with developing roller 24 (step S42). Specifically, as described above, controller 38 instructs rotating mechanism 29 as the first regulating part 32 to bring cleaning blade 25 into pressure contact with developing roller 24.

Then, controller 38 starts image formation (step S44). Then, the process ends (END).

In the developing device in accordance with Embodiment 2 of the present invention, it is possible to eliminate the strain on developing roller or the like as described above, by the preliminary rotation before image formation. At this time, cleaning blade 25 is separated from developing roller 24 and, therefore, friction with cleaning blade 25 as developing roller 24 rotates can be avoided, and wear of developing roller 24 is reduced.

In the main rotation for image formation, developing roller 24 and feed roller 21 rotate in the directions such that the surfaces of them proceed in the opposite directions at the contact area. If such a rotation is done as the preliminary rotation without supplying the liquid developer, torque between the rollers increases, which possibly makes the rotation unstable. The increase of the torque can be prevented by rotating developing roller 24 and feed roller 21 in the same direction at the contact area. Here, it is more desirable that developing roller 24 and feed roller 21 are rotated without any difference in speed at the contact area.

In the present example, before the preliminary rotation, the liquid developer in developer tank 5 is moved to regulating tank 42. Because of this process, when the rollers rotate, unnecessary drawing of liquid developer from developer tank 5 can be prevented, and the liquid is not wasted.

The timing when cleaning blade 25 is again brought into contact with developing roller 24 is after the liquid developer is supplied to developer tank 5, the liquid developer is drawn up and adherence of the liquid developer on developing roller 24 is detected. Specifically, the liquid developer exists between cleaning blade 25 and developing roller 24 and, therefore, abnormal friction can be prevented.

In this embodiment also, the preliminary rotation may be executed when the power is turned ON, as in Embodiment 1.

Modification 1

Figure 14:
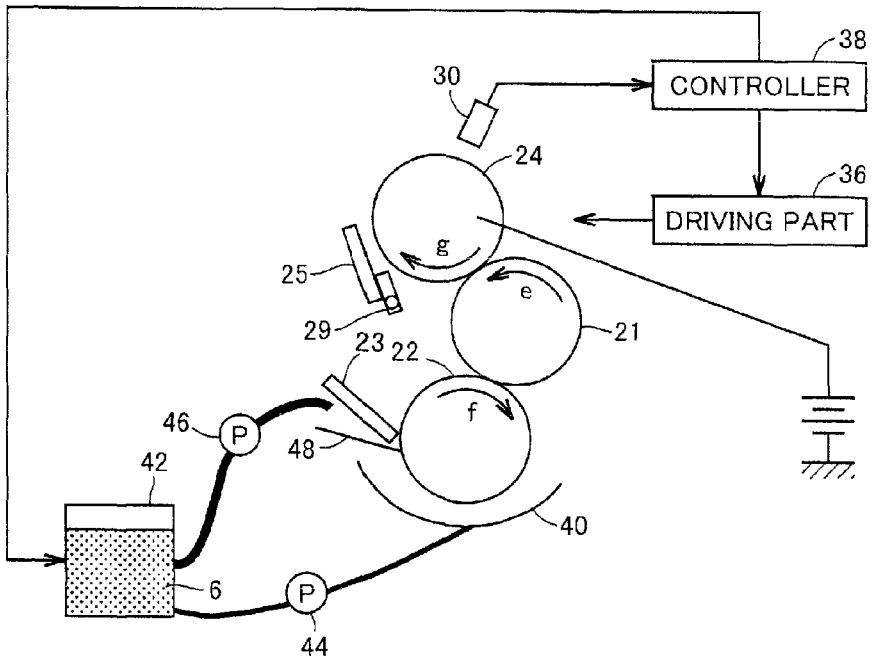
FIG. 14 shows a configuration of a developing device in accordance with Modification 1 of Embodiment 2 of the present invention.

FIG. 14 shows a configuration of a developing device in accordance with Modification 1 of Embodiment 2 of the present invention.

Referring to FIG. 14, the developing device in accordance with Modification 1 of Embodiment 2 of the present invention is different from the configuration shown in FIG. 10 in that it is not provided with developer tank 5. Specifically, in place of developer tank 5, a collecting member 40 and a resin sheet 48 for supplying the liquid developer fed from pump 46 to draw-up roller 22 are provided.

Resin sheet 48 has a length enough to supply the liquid developer entirely along the longitudinal direction of draw-up roller 22.

In the present configuration, draw-up roller 22 is not dipped in the liquid developer. Specifically, in the main rotation for image formation, the liquid developer is fed from pump 46 to resin sheet 48, and a liquid pool is formed above a portion between resin sheet 48 and regulating member 23. The liquid developer that passed the regulating member 23 is fed to draw-up roller 22. The liquid developer dripped from draw-up roller 22 is collected by collecting member 40 and again taken out to regulating tank 42 by pump 44.

In the preliminary rotation, supply of the liquid developer from pump 46 is stopped, and therefore, the liquid developer is not carried by the rotation of rollers. Thus, unnecessary consumption can be prevented.

In the configuration of developing device in accordance with Modification 1 of Embodiment 2 of the present invention, the process substantially the same as that described with reference to FIG. 13 can be executed, except for minor difference derived from the absence of developer tank 5. Specifically, at step S30, supply of the liquid developer by pump 46 is stopped; and at steps S36 and S38, supply of the liquid developer by pump 46 through resin sheet 48 to draw-up roller 22 starts, and rotation of developing roller 24, feed roller 21 and draw-up roller 22 starts at the same time. Except for these points, the process is the same as described with reference to FIG. 13. Therefore, detailed description thereof will not be repeated. Here, an example is shown in which at the time of preliminary rotation, controller 38 instructs driving part 36 to rotate feed roller 21 in the direction "e". In the preliminary rotation, developing roller 24 and draw-up roller 22 rotate as driven rollers.

In this configuration also, it is possible to eliminate the strain on the developing roller or the like as described above, by the preliminary rotation of developing roller 24 before image formation. At this time, cleaning blade 25 is separated from developing roller 24 and, therefore, friction with cleaning blade 25 as developing roller 24 rotates can be avoided, and wear of developing roller 24 is reduced.

Further, increase of the torque can be prevented by rotating developing roller 24 and feed roller 21 in the directions such that the surfaces of them proceed in the same direction at the contact area in the preliminary rotation. Here, it is more desirable that developing roller 24 and feed roller 21 are rotated without any difference in speed at the contact area.

Further, in the present example, supply of the liquid developer is stopped before the preliminary rotation. By this process, unnecessary consumption of the liquid developer can be prevented.

The timing when cleaning blade 25 is again brought into contact with developing roller 24 is after the liquid developer is again supplied from pump 46 and adherence of liquid developer on developing roller 24 is detected. Since the liquid developer exists between cleaning blade 25 and developing roller 24, excessive friction can be prevented.

Modification 2

Figure 15:
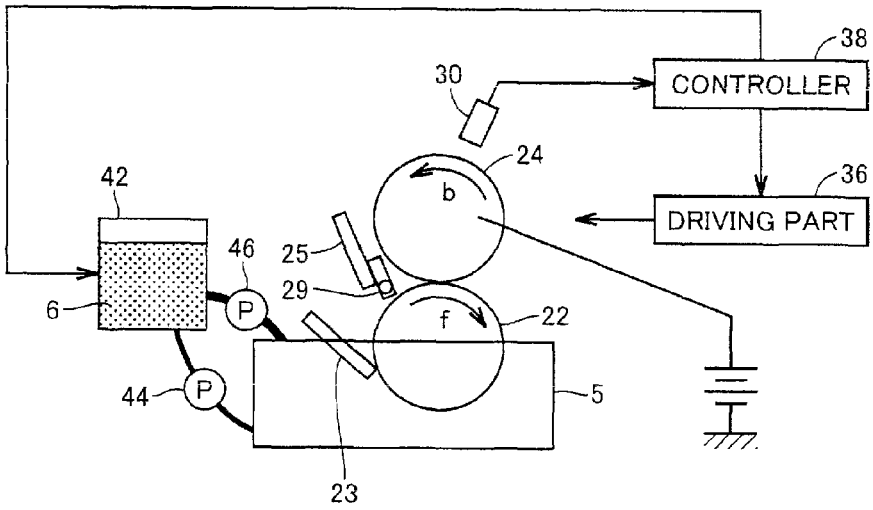
FIG. 15 shows a configuration of a developing device in accordance with Modification 2 of Embodiment 2 of the present invention.

FIG. 15 shows a configuration of a developing device in accordance with Modification 2 of Embodiment 2 of the present invention.

Referring to FIG. 15, the developing device in accordance with Modification 2 of Embodiment 2 of the present invention is different from the configuration shown in FIG. 12 in that feed roller 21 is removed. Except for this point, the configuration is the same as that described with reference to FIG. 12. Therefore, detailed description thereof will not be repeated.

In the present example, draw-up roller 22 functions as a carrying member carrying the liquid developer to the developing roller.

Here, an example is shown in which at the time of preliminary rotation, controller 38 instructs driving part 36 to rotate developing roller 24 in the direction "b". Here, in the preliminary rotation, draw-up roller 22 rotates as a driven roller.

In the configuration of developing device in accordance with Modification 2 of Embodiment 2 of the present invention, the process similar to that described with reference to FIG. 13 can be executed.

The same effect of Embodiment 2 described above can be attained in the present configuration.

Further, since feed roller 21 is eliminated, the number of components can be reduced and the configuration can be simplified.

Though embodiments and modifications of the present invention have been described with reference to wet developing devices as examples, the present invention is similarly applicable to dry developing devices.

By way of example, in a dry monocomponent developing device including a developing roller for developing an electrostatic latent image on a photoreceptor, a cleaning member in contact with the developing roller, a carrying roller for carrying the developer to the developing roller and a developer tank for supplying the developer to the carrying roller, it is possible to execute preliminary rotation for a prescribed time period, to eliminate strain on the developing roller as an elastic member.

Further, at the time of preliminary rotation, by separating the cleaning member from the developing roller, wear of the developing roller can be prevented.

Further, by stopping supply of the developer to the developing roller at the start of preliminary rotation, it is possible to prevent wasteful consumption or degradation of the developer. As a specific example, the developer in the developer tank may be saved to a reservoir tank provided in the vicinity. Here, passing of the developer between the developer tank and the reservoir may be realized by operating a carrying screw and a valve provided at an inlet/outlet.

Further, by starting supply of the developer to the developing roller immediately before the end of preliminary rotation, the time until the start of image formation can be reduced, and the friction between the cleaning member and the developing member when the rotation is switched to the main rotation can be prevented and, hence, wear of the developing roller can be prevented. In the present example, it is preferred that the developer that has been saved in the reservoir is returned to the developer tank by rotating the carrying screw in the opposite direction.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus, comprising:

a rotary development member that carries developer to form a toner image on an image carrier;

a cleaning member arranged in contact with the rotary development member, wherein the cleaning member removes the developer left on the rotary development member at a time of main rotation for image formation;

a rotary carrying member arranged in contact with the rotary development member, the rotary carrying member carries and feeds the developer to the rotary development member;

a regulatory mechanism that separates the cleaning member and the rotary development member from each other;

a driving part that rotates at least one of the rotary carrying member and the rotary development member;

a controller that controls the driving part and the regulatory mechanism such that the rotary development member performs a preliminary rotation with the cleaning member separated from the rotary development member, before the main rotation, wherein feeding of the developer to the rotary development-member is stopped before the preliminary rotation; and a detector that detects the developer carried on the rotary development member; wherein feeding of the developer to the rotary carrying member is restarted and the developer is fed to the rotary development member after the preliminary rotation before the main rotation; and the regulatory mechanism brings the cleaning member into contact with the rotary development member after the developer carried on the rotary development member is detected by the detector.

2. An image forming apparatus, comprising:

a rotary development member that carries developer to form a toner image on an image carrier;

a cleaning member arranged in contact with the rotary development member, wherein the cleaning member removes the developer left on the rotary development member at a time of main rotation for image formation;

a rotary carrying member arranged in contact with the rotary development member, the rotary carrying member carries and feeds the developer to the rotary development member;

a regulatory mechanism that separates the cleaning member and the rotary development member from each other;

a driving part that rotates at least one of the rotary carrying member and the rotary development member;

a storage container for storing the developer; and a drawing-up member arranged in contact with the rotary carrying member and at least partially dipped in the developer stored in the storage container, wherein the drawing-up member draws up and feeds the developer to the rotary carrying member; wherein the controller separates the drawing-up member and the rotary carrying member from each other at the time of the preliminary rotation;

a controller that controls the driving part and the regulatory mechanism such that the rotary development member performs a preliminary rotation with the cleaning member separated from the rotary development member, before the main rotation, wherein feeding of the developer to the rotary development-member is stopped before the preliminary rotation; and a detector that detects the developer carried on the rotary development member; wherein the drawing-up member and the rotary carrying member are brought into contact with each other so that the developer is fed to the rotary carrying member and is fed to the rotary development member after the preliminary rotation before the main rotation; and the regulatory mechanism brings the cleaning member into contact with the rotary development member after the developer on the rotary development member is detected by the detector.

3. An image forming apparatus, comprising:

a rotary development member that carries developer to form a toner image on an image carrier;

a cleaning member arranged in contact with the rotary development member, wherein the cleaning member removes the developer left on the rotary development member at a time of main rotation for image formation;

a rotary carrying member arranged in contact with the rotary development member, the rotary carrying member carries and feeds the developer to the rotary development member;

a regulatory mechanism that separates the cleaning member and the rotary development member from each other;

a driving part that rotates at least one of the rotary carrying member and the rotary development member;

a storage container for storing the developer to be fed to the rotary carrying member; and a pump mechanism for pumping the developer into the storage container to have the rotary carrying member at least partially dipped in the developer at the time of main rotation, and pumping the developer out of the storage container to prevent the rotary carrying member from being dipped in the developer at the time of preliminary rotation;

a controller that controls the driving part and the regulatory mechanism such that the rotary development member performs a preliminary rotation with the cleaning member separated from the rotary development member before the main rotation, wherein feeding of the developer to the rotary development-member is stopped before the preliminary rotation; and a detector that detects the developer carried on the rotary development member; wherein the pump mechanism feeds the developer to the storage container to be fed to the rotary development member through the carrying member after the preliminary rotation before the main rotation; and the regulatory mechanism brings the cleaning member into contact with the rotary development member, after the developer carried on the rotary development member is detected by the detector.

* * * * *